US008316788B2

(12) United States Patent
Willis

(10) Patent No.: US 8,316,788 B2
(45) Date of Patent: Nov. 27, 2012

(54) COLLAPSIBLE KAYAK

(76) Inventor: Anton Michael Willis, Oakland, CA (US)

( * ) Notice: Subject to any disclaimer, the term of this patent is extended or adjusted under 35 U.S.C. 154(b) by 7 days.

(21) Appl. No.: 12/804,357

(22) Filed: Jul. 20, 2010

(65) Prior Publication Data

US 2011/0017121 A1 Jan. 27, 2011

Related U.S. Application Data

(60) Provisional application No. 61/271,521, filed on Jul. 21, 2009.

(51) Int. Cl.
*B63B 7/00* (2006.01)

(52) U.S. Cl. ..... 114/347; 114/354

(58) Field of Classification Search ..... 114/352, 114/353, 347, 355–358
See application file for complete search history.

(56) References Cited

U.S. PATENT DOCUMENTS 2,969,551 A * 1/1961 Snider ..... 114/355
3,806,972 A * 4/1974 Jackowski ..... 114/357
6,006,691 A * 12/1999 Wilce ..... 114/353
6,367,405 B1 4/2002 Smiley
6,615,762 B1 9/2003 Scott

* cited by examiner

*Primary Examiner* — Edwin Swinehart
(74) *Attorney, Agent, or Firm* — Howard Cohen

(57) ABSTRACT

A collapsible watercraft is comprised of a single high-strength foldable panel to fold into the form of a kayak with integrally defined keel, hull, sides, and deck. Using a single sheet of high strength panel creased in a predetermined pattern to form living hinges, the panel may be folded and transformed from self-defined compact knocked down package, into a rigid three dimensional tubular manifold in a kayak form that is optimized for performance in the water. Other removable rigid structural members, primarily a cockpit rim, rib, and floorboards help maintain the shape and integrity of the shell.

22 Claims, 9 Drawing Sheets

COLLAPSIBLE KAYAK

CROSS-REFERENCE TO RELATED APPLICATIONS

This application claims the benefit of the filing date of Provisional Application No. 61/271,521, filed Jul. 21, 2009.

FEDERALLY SPONSORED RESEARCH

Not applicable.

SEQUENCE LISTING, ETC ON CD

Not applicable.

BACKGROUND OF THE INVENTION

1. Field of the Invention

This invention relates to personal watercraft and, more particularly, to watercraft that are portable and capable of being knocked down and erected easily with few or no tools required.

2. Description of Related Art

The present invention is a new type of collapsible kayak (a small paddle-powered watercraft with a covered deck). Using an innovative design system of structural folds in a semi-rigid plastic skin, it achieves unprecedented benefits in terms of performance, weight, portability, ease of assembly, aesthetics and manufacturing cost.

Kayaks, along with canoes and other lightweight, personal watercraft are commonly used for recreational travel on rivers, lakes and oceans. They are also used for fishing and hunting. Currently, commercial kayaks fall into three broad categories. The first and most common are rigid or "hard-shell" kayaks. These are typically made of rotomolded or thermoformed plastics, fiberglass, or plywood. While such watercraft have excellent performance characteristics, their large size and weight makes them difficult and inconvenient to store and transport.

Due to these difficulties, there is a significant demand for watercraft that can be collapsed into small packages for storage or transport. The simplest of these are inflatable boats, which use a system of air-filled pneumatic tubes to provide form, structure and flotation. While such watercraft are compact and inexpensive, they are typically slow and hard to maneuver, due to shape limitations imposed by pneumatic systems.

Conventional collapsible kayaks are of a "skin on frame" construction system. That is, they are made up of a structural skeleton, which can be broken down into smaller pieces for storage and transport, and a waterproof fabric skin which fits over the skeleton. This system has the following disadvantages:

- The structural skeleton is typically cumbersome and time-consuming to assemble, due to the large number of parts and connections.
- The skin and structure are two independent systems, with the skin contributing nothing to the strength and rigidity of the kayak. As such, the weight of all of the components is generally too high for these kayaks to be carried on foot for any distance, limiting usefulness in many camping and traveling applications.
- The skin fits loosely around the skeleton, increasing drag and decreasing performance, unless extra skin-tensioning elements—such as inflatable air tubes or mechanical jacks—are used.

- The cost of such kayaks is prohibitively high for many consumers. This is due to the high cost of manufacturing a large number of relatively complex parts—both in the structure and the fabric skin, which must be manually sewn out of several pieces with waterproof seams.

In recent years folding kayaks have been developed which, rather than a separate skin and structure, use systems of folding rigid panels. These address some of the problems of skin-on-frame systems, but until now, these have been outweighed by disadvantages:

- Due to their folding geometries, such kayaks typically have an angular, boxy form which adversely affects stability, speed and overall performance in the water, as well as aesthetics.
- Such rigid folding kayaks either only fold longitudinally—thus not decreasing the longest dimension for transport—or must be assembled from multiple pieces, which creates structurally weak and leak-prone seams.

BRIEF SUMMARY OF THE INVENTION

The present invention seeks to resolve the above problems with collapsible watercraft through an entirely different system of construction and assembly. A fundamental aspect of the invention is the use of a single high-strength foldable panel to fold into the form of a kayak with integrally defined keel, hull, sides, and deck. Using a single folded sheet of high strength, foldable paneling yields the following benefits:

- The form is graceful and made up of continuous curves, for superior performance and aesthetics.
- The strength to weight ratio is outstanding, due to both the monocoque structure, and the specific materials used in the assembly.
- The design minimizes seams which could impart weakness and leakage, especially below the waterline.
- Assembly in the field is simple and quick, with a minimum of loose parts and complicated joints.
- The kayak is fast and offers enhanced performance due to its rigid, smooth skin.
- The panel that forms the kayak may be refolded to define its own transport case in its compactly folded configuration. This case holds the disassembled rib and structural members, as well as paddles and other accessories. This eliminates the need for a separate carrying case or bag, further reducing the weight and cost of the system.
- The folded kayak is extremely portable, with dimensions of approximately 32"×26"×6", and weighing approximately 15 pounds.
- The materials and manufacturing processes are widely available and commonly utilized and inexpensive, meaning that the invention can be produced at a cost well below that of other kayak types.
- The material used may be inexpensively screen-printed as a flat sheet. This allows extensive application of graphics, patterns and logos which are not practical in the manufacture of conventional kayaks.

The key to the present invention is a folded rigid shell formed by a folded, one-piece skin panel, which acts as both waterproof envelope, and primary structure. By means of folding along pre-formed creases, it can be transformed from a compact knocked down package, into a rigid three dimensional erected form which is optimized for performance in the water. Other removable rigid structural members, primarily a cockpit rim, rib, and floorboards help maintain the shape and integrity of the shell.

The preferred material for the folded shell is a twin-walled, extruded polypropylene/polyethylene panel, commonly sold under the trade-names Coroplast™, Cor-X™, Inteplast™, and Solexx™. Its benefits to the present invention include:

The material's unique ability to form a "living hinge"; that is, to be folded and unfolded along a crease or fold line ad infinitum, without weakening or tearing. These hinges can be created by simply applying mechanical force along any desired crease line; this force crushes the structural corrugations and creates a permanent, reusable folding crease. This is typically accomplished with a steel rule die, which allows all cuts, creases and holes in a sheet to be formed in a single die-stamping operation.

Superior strength-to-weight ratio, due to the twin-walled extrusion profile.

Superior toughness and durability.

Positive buoyancy from the air trapped between the twin walled cells of the material, which allows the kayak to float even when completely capsized, for retrieval and rescue.

The key to the present invention is the particular crease pattern imparted to the panel to form the hull of the foldable shell. It is this pattern which allows for the collapsibility of the kayak, while creating a rigid and high-performing form in the water. It also enables the panel to form its own self-storage case. In the preferred embodiment, the skin is formed from a single Coroplast™ panel measuring approximately 5' by 12'6"; sizes can be altered depending on the size of kayak desired.

DESCRIPTION OF THE PREFERRED EMBODIMENT

The present invention generally comprises a kayak construction designed to create a lightweight, portable, foldable watercraft. A key feature of the invention is that the kayak is formed of a single panel of high strength, bendable, foldable plastic material. The panel is shaped and creased so that it may be folded and assembled into the kayak form for water transport, and may be refolded and reassembled to form an integral self-storage carrying case for storage and transport. The preferred material for the folded shell is a twin-walled, extruded polypropylene/polyethylene panel, commonly sold under the trade-names Coroplast™, Cor-X™, Inteplast™, and Solexx™. These materials combine high strength, positive buoyancy, ability for form living hinges, and durability, all essential for the purposes of the invention.

Figure 5:
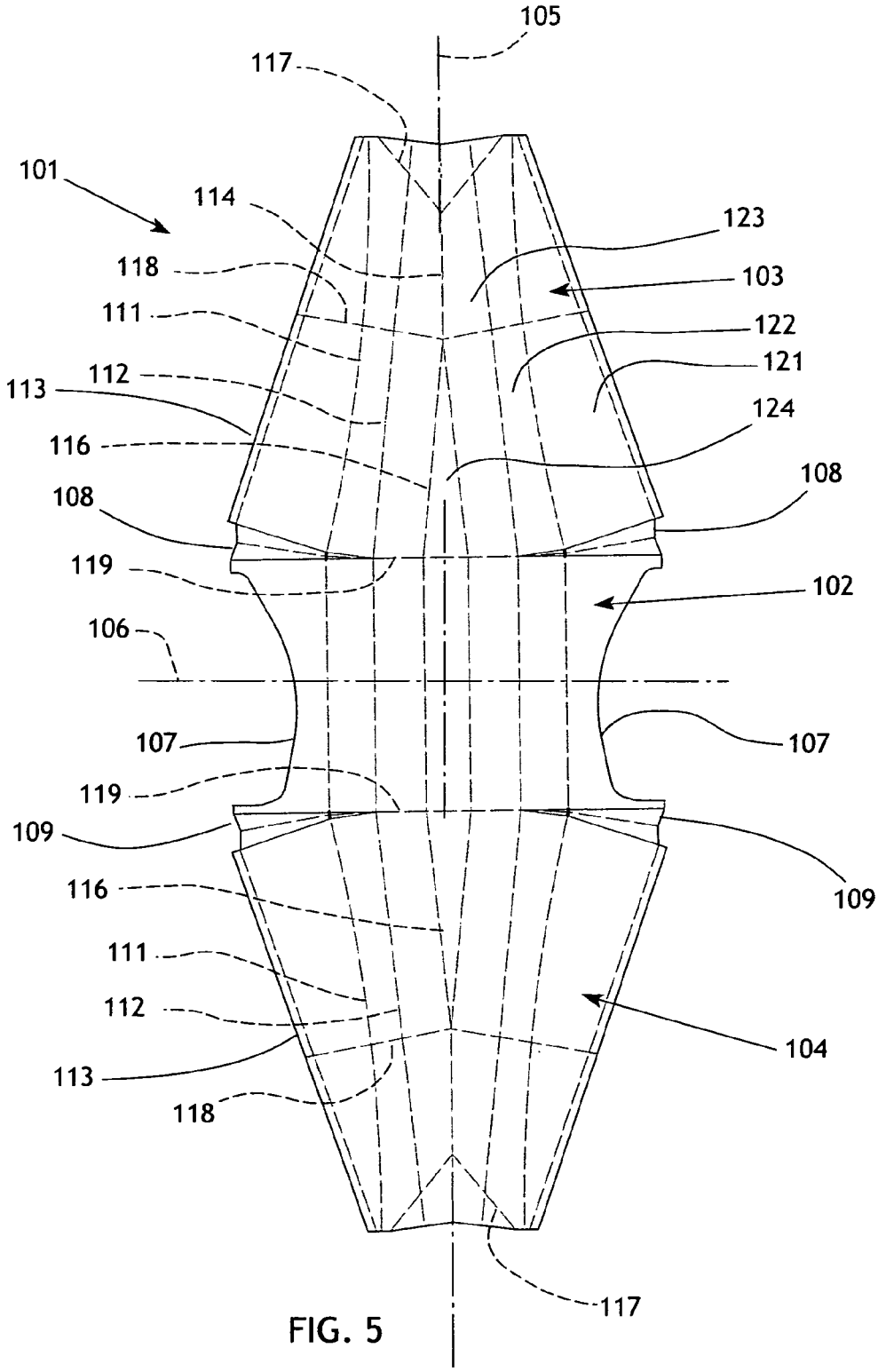
FIG. 5 is a plan view of the creased and cut panel that forms the hull, sides, and deck of the kayak of the invention.

With regard to FIG. 5, the panel 101 that comprises the integral hull, sides, and deck of the kayak is formed of the double-wall material noted above having a large plurality of corrugation ribs extending between the walls to define a large plurality of air-filled tubular voids. The panel is provided with a perimeter shape and crease or fold lines that define the axes where the panel will fold when bent by hand to form the configuration of the assembled kayak.

The panel is generally formed with a central section 102 and end sections 103 and 104 extending in opposite directions. The panel 101 is generally symmetrical (enantiomorphic) with respect to a longitudinal axis 105, and the ends 103 and 104 are substantially symmetrical about a lateral-medial axis 106. The end sections 103 and 104 are generally described as truncated conical shapes, and the central section is a rectangle with laterally opposed side edges 107 that are concave, scalloped shapes to define the cockpit perimeter, as will be described below. In addition, a pair of darts 108 (in the manner of tapered tucks provided in fabric constructions and garments) are disposed between the central section 102 and the end section 103, the darts flaring laterally outwardly in laterally opposed fashion. Likewise, another pair of darts 109 extend between the central section and the end section 104 in symmetrical relationship to the first pair.

A plurality of permanent fold lines extend longitudinally the length of the panel 101 and define the hull, sides, and deck of the assembled kayak. Each side of the panel is provided with fold lines 111 and 112 that extend in generally parallel, spaced apart relationship and are aligned intermediate of the longitudinal axis 105 and the tapered edge 113 of section 103. Fold line 11 is curved to define the boat-like curvature of the hull and deck forms, and distinguishes this kayak from other "boxy" rigid folding boats. Each side also includes a longitudinal fold line 114 extending along the longitudinal axis from each end toward the central section 102, and it bifurcates to define fold lines 116 that extend generally parallel to fold lines 111 and 112. In general, the panel portion between outer edge 113 and fold line 111 comprises a portion of the deck 121 of the kayak, the panel portion between lines 111 and 112 forms the side (freeboard) 122 of the kayak, the panel portion between lines 112 and 116 defines the hull 123 of the kayak, and the panel portion between opposed lines 116 comprises the keel 124 of the watercraft. In addition, a V-shaped fold line 117 extends into each end of the panel to define a folded-in dart, as will be described below.

In addition to the longitudinal fold lines and the darts 108, 109, the panel 101 is also provided with transverse fold lines that enable the panel to be folded into a compact storage configuration in which it forms its own case for carrying and transport. A pair of fold lines 119 are provided at opposite ends of the central section 102, demarcating the boundaries with the end sections 103 and 104 and each defining one edge of each of the darts 108 and 109. A pair of fold lines 118 extend in the end sections 103 and 104, each fold line oriented generally transverse to the adjacent outer edge 113 and intersecting the longitudinal axis 105. These fold lines 118 and

119 enable the panel 101 to be folded so that the ends may be brought together in accordion fashion to form a compact knocked down configuration. It may be appreciated that when the panel is folded into the kayak configuration with longitudinally extending vertices, those vertices transect the lateral fold lines and prevent bending movement along the lateral fold lines.

Figure 1:
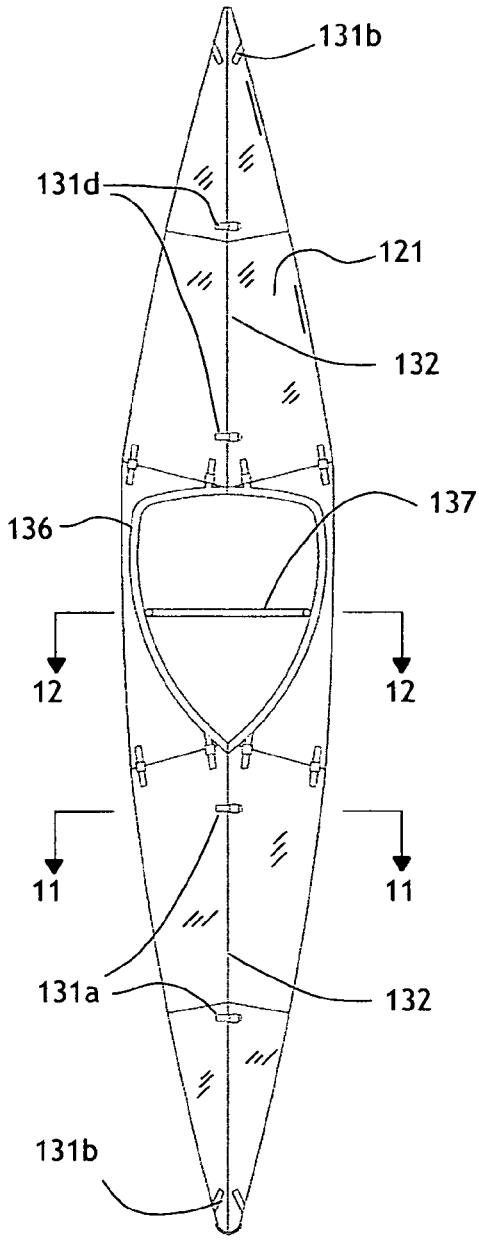
FIG. 1 is a plan view of the kayak of the present invention, shown in the fully assembled condition.
Figure 13:
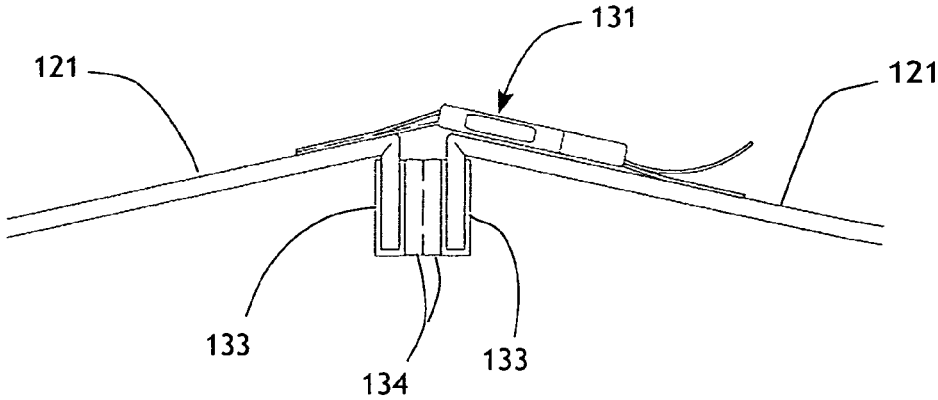
FIG. 13 is an enlarged detailed view of the buckle and strap assembly joining the deck seam of the kayak.

The panel 101 is further provided with mechanisms or devices to releasably secure the panel in the assembled kayak configuration. With regard to FIGS. 1-3, one form of the joining assembly uses a plurality of strap-and-buckle assemblies 131, sewn or welded to the corrugated plastic skin. As shown in FIG. 13, separable "snap lock" buckles 131 cross the deck seam 132, so that engaging the buckles and tightening the straps achieves a strong connection between the two confronting edges 113 of the deck assembly. Inward-folded flaps 133 of the corrugated plastic may be provided to form a weathertight seal; in the embodiment shown in FIG. 13, the flaps 133 are permanently covered with u-shaped plastic channels which exclude water, sand and the like from entering the open corrugations of the plastic skin. These channels have an adhesive foam-rubber weatherstrip 134 applied thereto and extending the length of the deck seam 132, so that when the strap assembly is closed, water is substantially excluded from the interior of the kayak.

In an alternate embodiment, the u-shaped plastic trim applied to the edge 113 of the panel 101 may have a custom cross-sectional profile, which allows the two deck edges to mechanically mate together, and substantially exclude water from the kayak.

An alternate form of deck closure uses heavy-duty zippers sewn or welded to the corrugated plastic skin. Two separable zippers run from bow to cockpit and stern to cockpit, respectively. By engaging the zippers and zipping the deck up from bow or stern to cockpit, a rapid and continuous assembly is achieved.

In another embodiment of the deck closure assembly, a rigid slotted tube may be provided to mechanically engage the plastic trim applied to the deck edges 113. As this tube is slid over the confronting edges, from the cockpit towards the bow or stern, it draws and clamps together the two deck edges, providing additional structural reinforcement as well as excluding water from the kayak.

Figure 8:
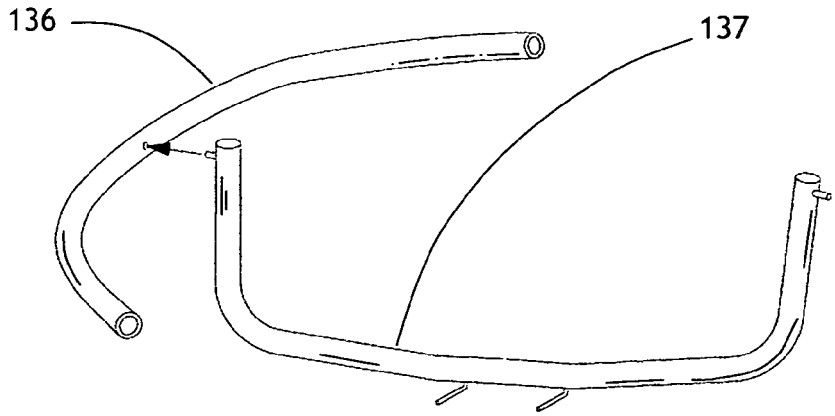
FIG. 8 is a perspective view of the assembly of the cockpit rim and the central rib of the kayak.
Figure 12:
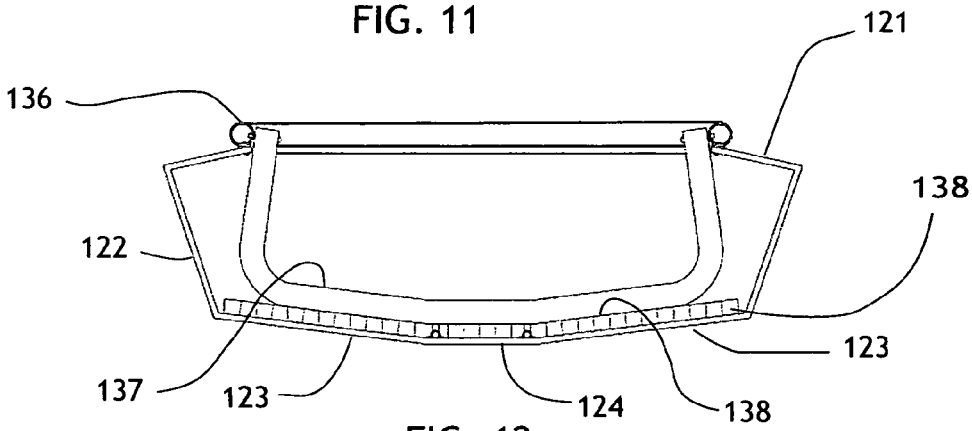
FIG. 12 is a cross-sectional elevation of the kayak, taken along line 12-12 of FIG. 1.

The panel 101 is further provided with a plurality of tubular cockpit rim components 136, as shown in FIG. 8, which are curved to conform to the shape of the edges 107 of the central section of the panel. The rim components may be formed of tubular metal, plastic, reinforced polymer, and the like. They are fastened to the edges 107 with rivets, screws or the like, or can be made removable. These rim components are joined together in a closed loop in the assembled kayak, using pin-and-socket connections or the like. The rim components 136 maintain the shape of the cockpit opening, and distribute stresses that would otherwise concentrate at this large opening of the assembled kayak. In addition, a U-shaped cross-rib 137 is dimensioned to be placed in the cockpit area of the kayak, as shown in FIG. 12. The ends of the cross-rib are secured to opposite sides of the cockpit rim components 136 by pins, grommets, or brackets The rib supports much of the weight of the occupant of the kayak, and helps to distribute forces which might otherwise tear or distort the skin. Additional ribs may be incorporated into the design following the same system, if a longer or more rigid kayak is desired.

Figure 9:
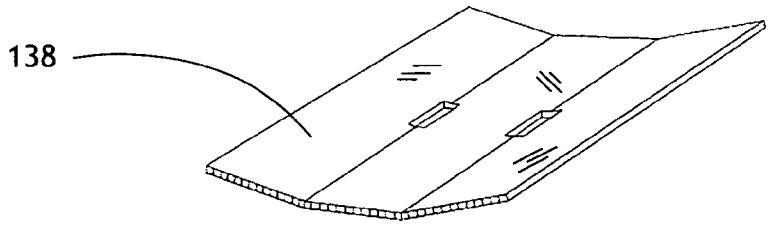
FIG. 9 is a perspective view of the floorboard of the kayak of the invention.

With regard to FIGS. 9 and 12, a rigid floorboard 138 is also provided, comprising a rectangular piece of a material similar to panel 101. The floorboard is shaped to be complementary to the underlying portion of the bottom of the kayak in the cockpit area, and is provided with fold lines that align substantially with the fold lines 116 of the kayak. The floorboard is placed against the bottom of the kayak, in the central section of the panel that forms the cockpit, and is provided to help maintain the shape of the kayak's bottom against water pressure and internal stresses in the skin. It also protects the skin by evenly distributing the weight of the occupant, and help to keep the cross-rib aligned perpendicular to the keel. The floorboard may be formed of a thicker and more rigid version of the outer shell material, or it can also be made of other rigid materials such as wood or plastic.

Figure 10:
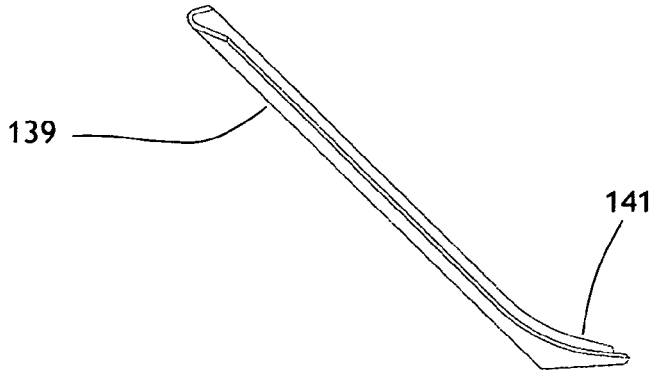
FIG. 10 is a perspective view of the bow fairing of the kayak.
Figure 11:
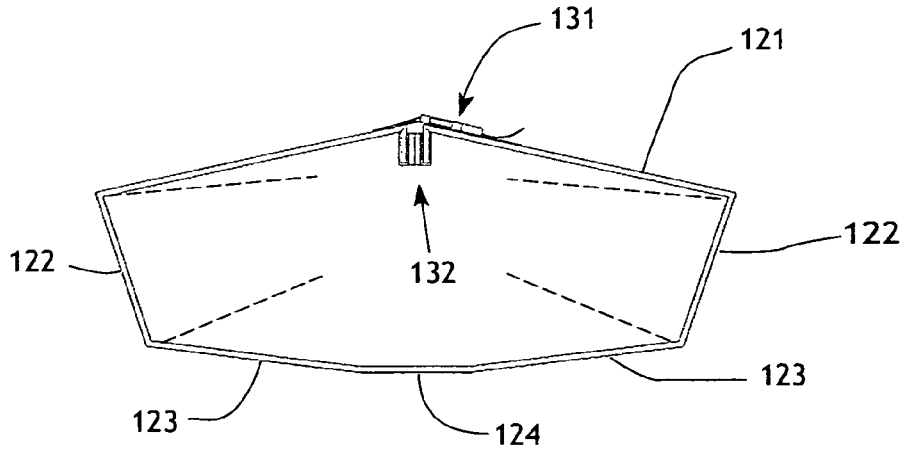
FIG. 11 is a cross-sectional elevation of the kayak, taken along line 11-11 of FIG. 1.

The kayak also includes a bow fairing 139, shown in FIG. 10, comprised of a channel-like strut that is complementary in size and form to the leading edge of the bow of the assembled kayak. The fairing 139 has a lower end with a shoe-like terminus 141 configured to conform to the intersection of the keel and leading edge of the hull. The fairing is provided to shield the leading edge of the hull from collisions with solid objects that might otherwise damage the kayak, recognizing that the leading edge is the likely locus of most impacts. It also helps to streamline the kayak for faster and more efficient forward motion through the water.

Figure 2:
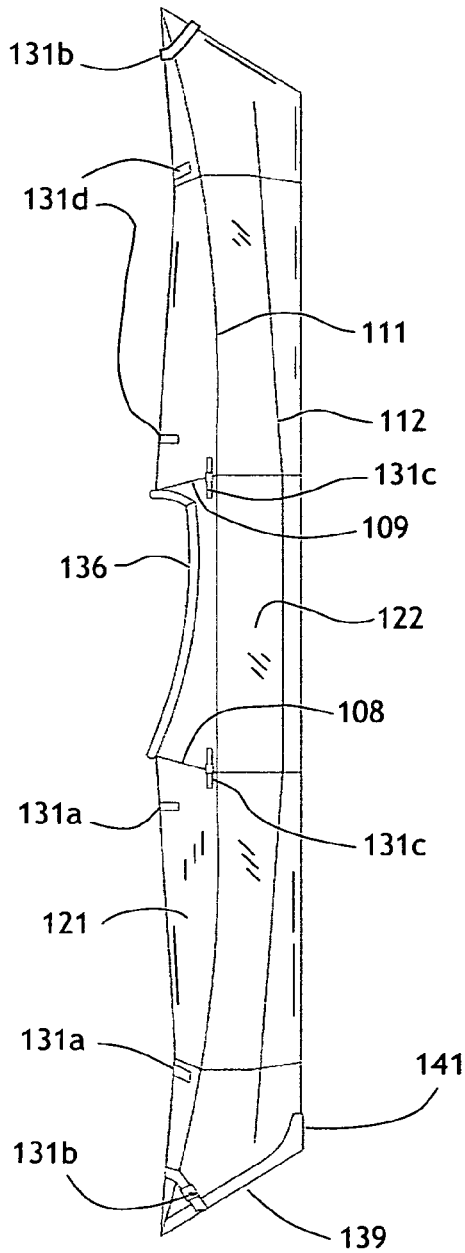
FIG. 2 is a side elevation of the kayak as shown in FIG. 1.
Figure 3:
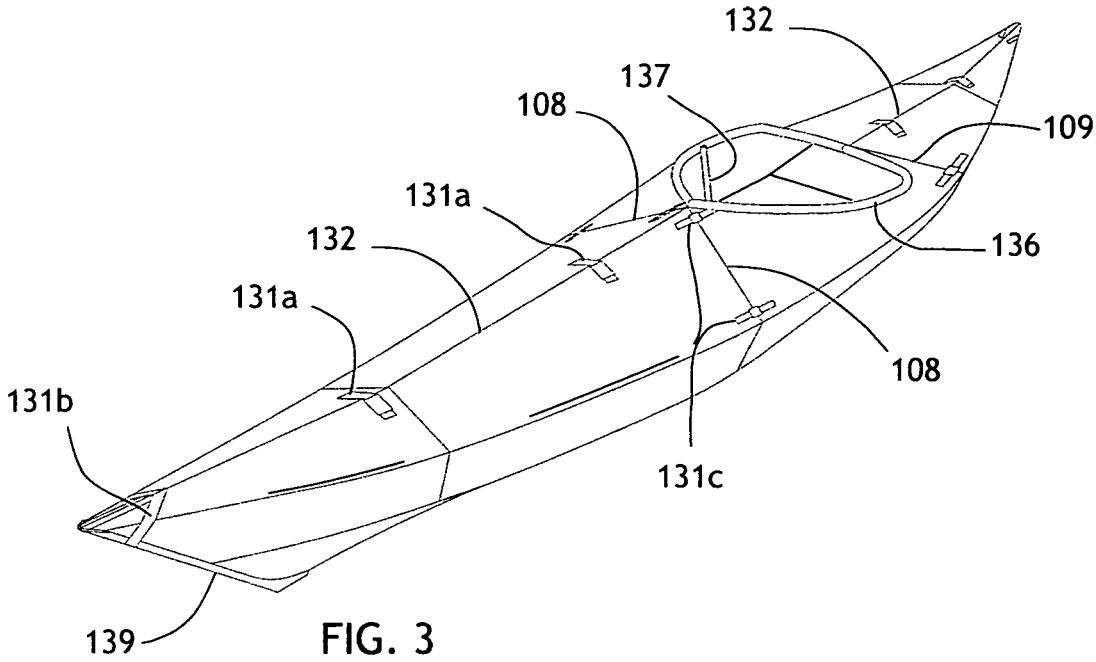
FIG. 3 is a oblique front perspective view of the kayak in the fully assembled condition.
Figure 4:
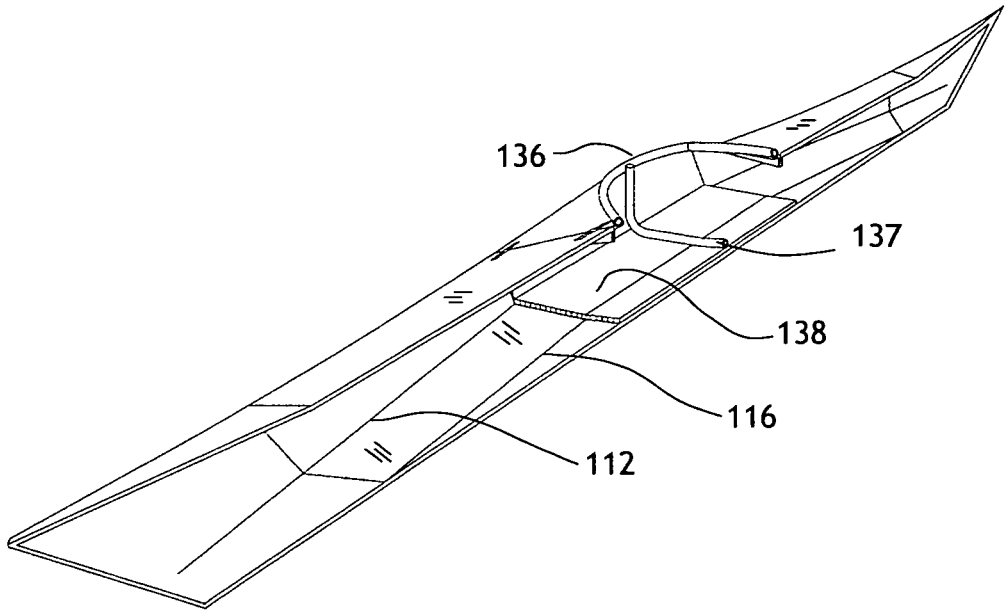
FIG. 4 is a longitudinally cutaway view of the fully assembled kayak in an oblique front perspective.
Figure 6:
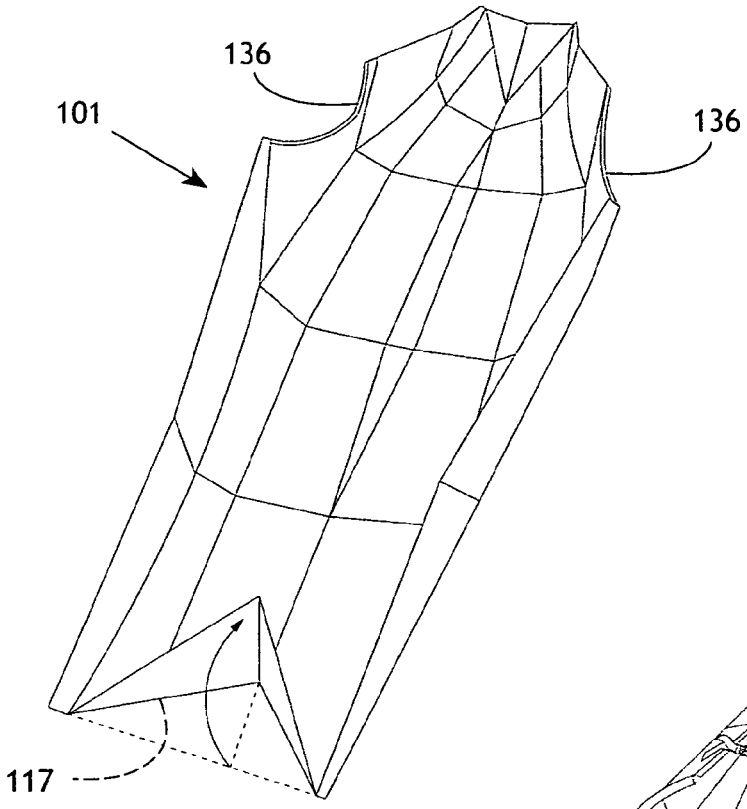
FIGS. 6 and 7 are sequential perspective views showing the first steps in folding the panel of FIG. 5 to form the assembled kayak.
Figure 7:
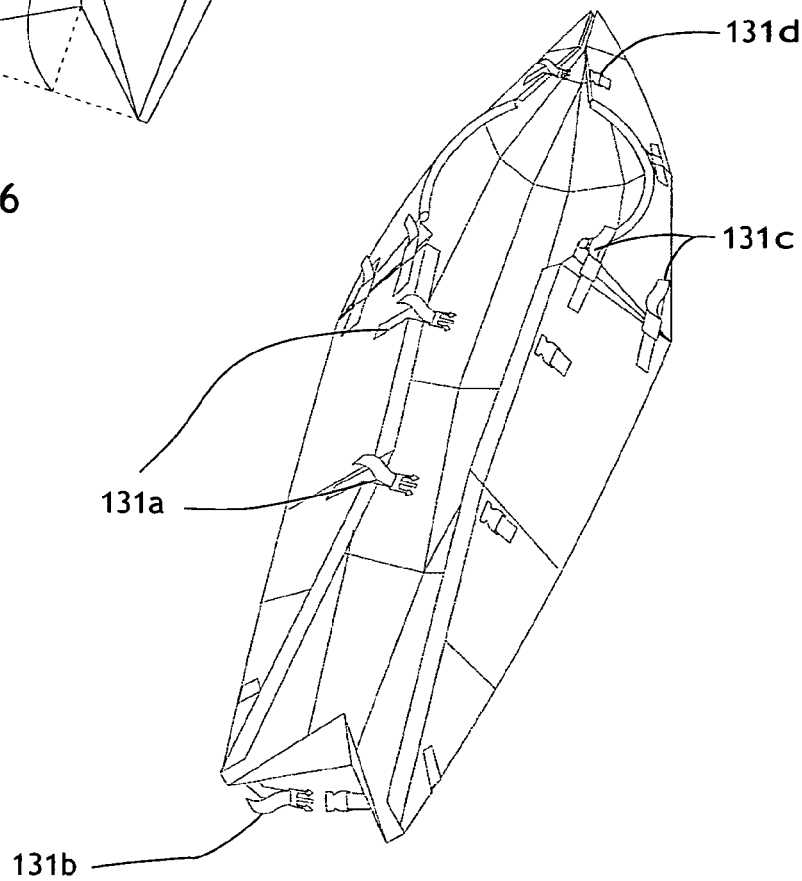
Figure 14:
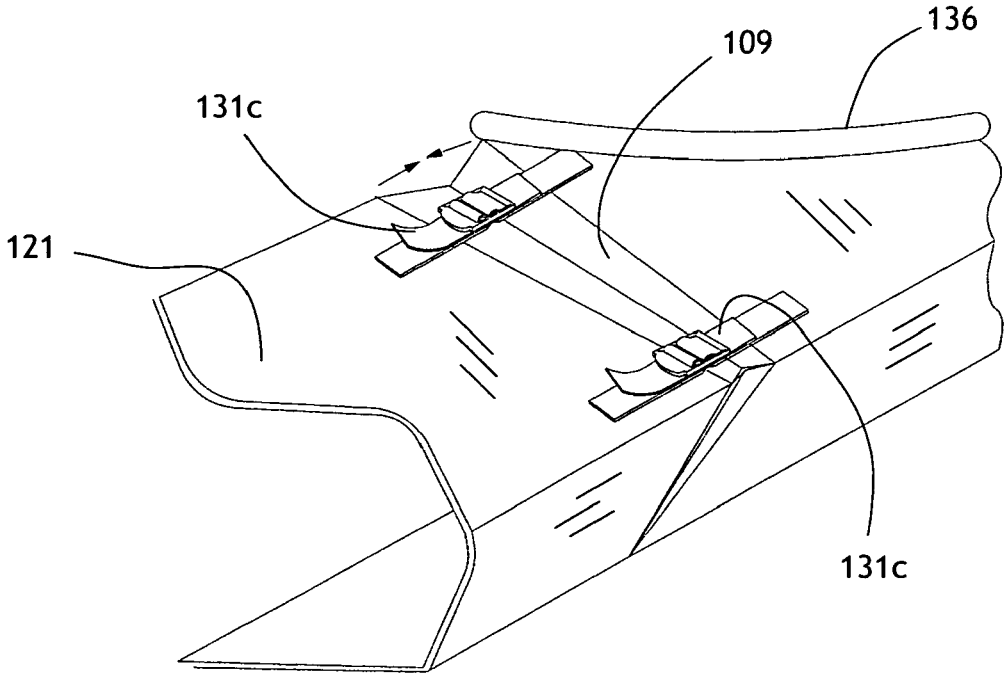
FIGS. 14 and 15 are detailed perspective views showing the sequential closure of a dart in the deck of the kayak.
Figure 15:
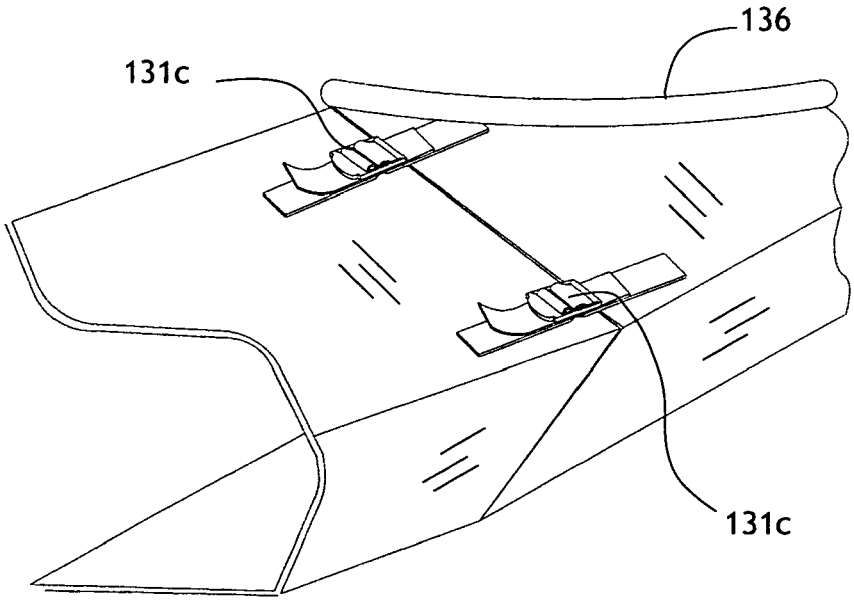

To set up the kayak, the user follows these steps:

1) The shell is unfolded from its "case" configuration, into a flat panel 101 as shown in FIG. 5.
2) The opposed edges 113 are rolled upwardly toward each other, as shown in FIG. 7, forming a tubular closed manifold tapered at opposed ends in the form of a kayak. The adjustable buckle assemblies 131*a* and 131*d* are joined at the bow and stern sections to loosely hold the panel 101 in this near-assembled configuration. The floorboard 138 is then placed in the bottom of the cockpit area formed by the central section 102, and the rim components 136 are joined end-to-end to form a rigid closed loop configuration.
3) The cross-rib 137 is placed in the cockpit area, and the free ends of the cross-rib are joined to the unified rim 136 with pins, fittings, straps, or the like. The cross-rib is joined to the keel of the kayak 124 with pins, fittings, straps or the like which pass through holes in the floorboard 138.
4) Bow and stern creases 117 are folded longitudinally inwardly in accordion fashion (FIG. 6) to form an upswept leading bow edge, and secured in place with adjustable buckle assembly 131*b* as shown in FIG. 7. Note that the bow fairing 139 is placed abutting the leading bow edge, within the strap 131*b* circumscribing the prow end of the kayak to join the fairing 139 thereto. Note also that the shoe end 141 conforms to the intersection of the leading edge with the hull and keel shape, as shown in FIGS. 2 and 3. Alternatively, hook-and-loop fasteners, or internal clamps may be used to assembly the bow and stern instead of the buckles 131. It is significant that the accordion fold along lines 117 bring together 4 plies of the panel material, which together exhibit substantial structural and impact strength. Foam-rubber weatherstripping may be applied to the mating surfaces of the bow and stern creases 117 in order to further exclude water.
5) The darts 108 and 109 (FIG. 14) are folded inwardly and secured with adjustable buckle assemblies 131*c* (FIG. 15). The darts serve to foreshorten the length of the deck 121 of the kayak with respect to the sides 122 and hull 123, causing the bow and stern to curve upwardly so that the watercraft may cut through waves and swells.
6) The adjustable buckle assemblies 131*d* are joined to bring together the rear deck seam, and all of the buckle assemblies are then tightened to seal the deck seams. The kayak is thus fully assembled, as shown in FIGS. 1-4, and ready for waterborne use.

The kayak in the assembled configuration is sleek, streamlined, and seaworthy. It should be noted that the kayak skin (the panel 101) has no openings, holes, seams, gaps, or plugs below the waterline that could otherwise leak and admit water into the kayak. Indeed, the only openings in the assembled watercraft are the sealed deck seams 132 and the cockpit itself. The cockpit rim components 136 may be fashioned to secure a kayak spray skirt, known in the prior art, to prevent water from entering the cockpit.

Note that the fold lines 111, 112, 114, 116-119, as well as the darts 108 and 109 form a pattern that is applied to the double-wall panel material through the use of a steel rule die or the like to crush the double-wall material along those lines to form living hinges that enable the panel to be folded along the fold lines to transform it from a planar object to a kayak watercraft to a self-formed carrying case. This pattern is a fundamental aspect of the invention. Dies may be applied to the panel in a heated state in order to achieve more flexible living hinges, especially in those areas, such as the darts 108 and 109, which require particularly tight folds.

Figure 16:
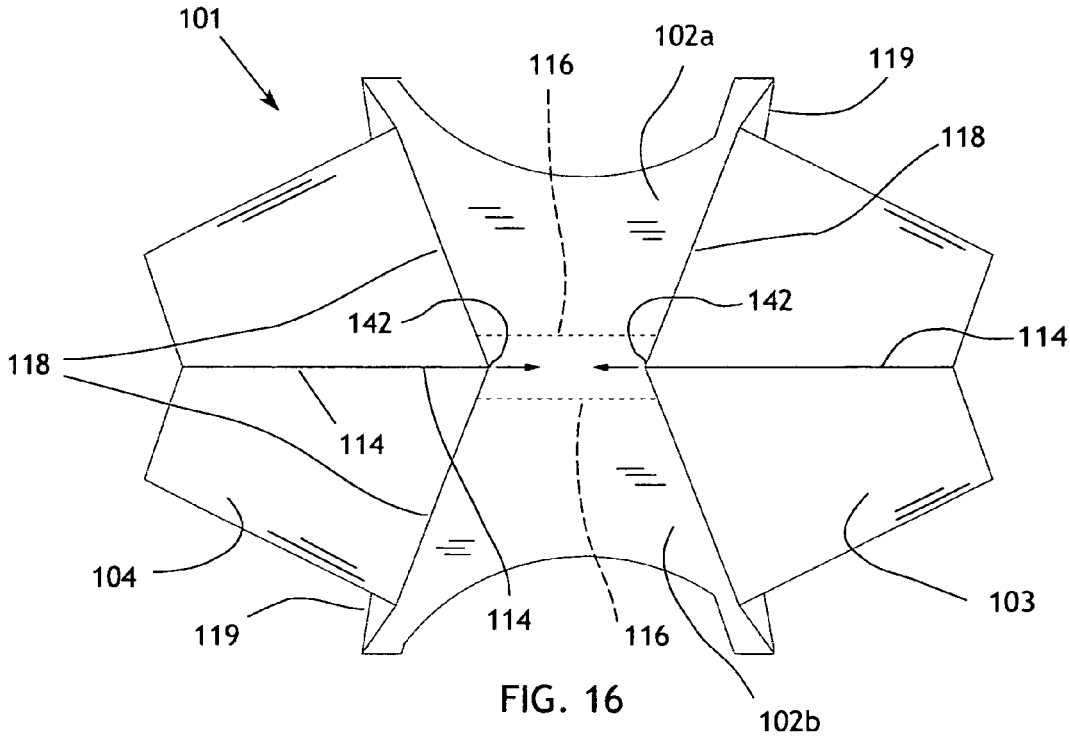
FIGS. 16-19 are a sequence of perspective views depicting the folding of the kayak into a compact case configuration for transport and storage.

To disassemble the kayak, the steps 106 above are generally reversed. The adjustable buckles 131*x* are released, the cockpit rim components 136 are disengaged from each other, the rib 137 is removed, and the floorboard 138 is removed. The panel 101 may then be folded into a configuration in which it forms its own integral case for self-storage of the panel 101 and the ancillary components (fairing 139, floorboard 138, and cross-rib 137). The panel is placed in a flattened disposition as shown in FIG. 5 and, as shown in FIG. 16, the opposed end sections 103 and 104 are folded upwardly along fold lines 119. At the same time, the end sections 103 and 104 are folded inwardly each toward the other along fold lines 118, forming converging vertices 142. The converging end sections 103 and 104 tend to draw together the opposed sides 102*a* and 102*b* of central portion 102, so that the opposed sides rotate each toward the other about fold lines 116.

Figure 17:
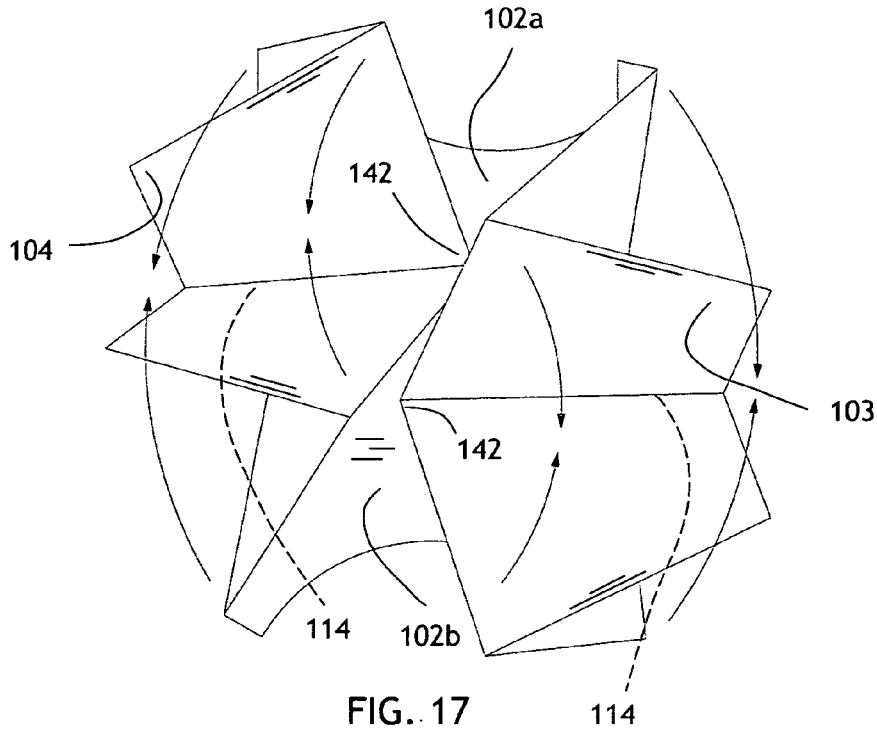
Figure 18:
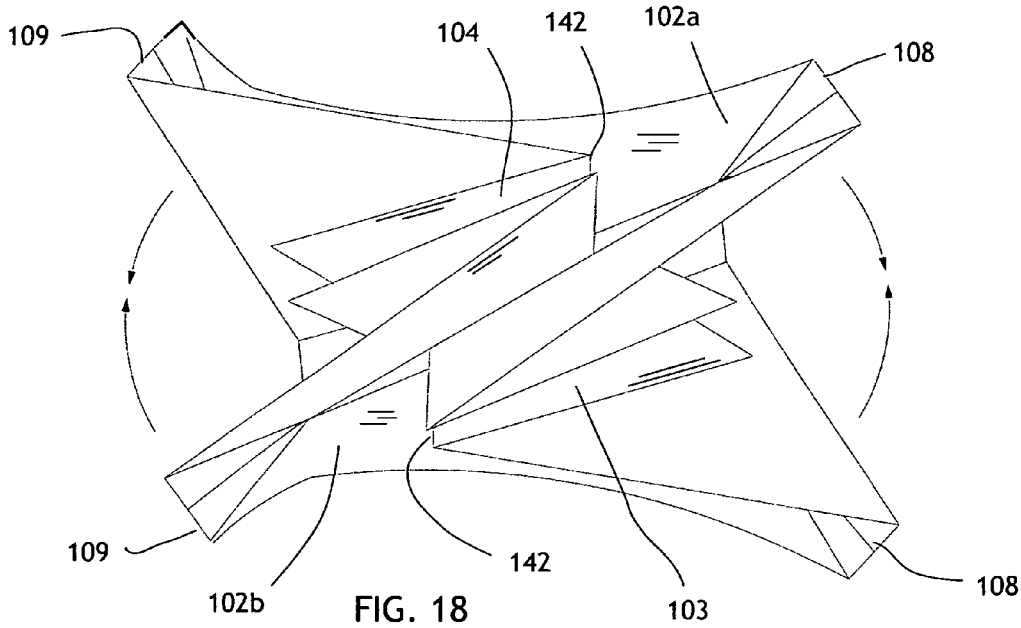
Figure 19:
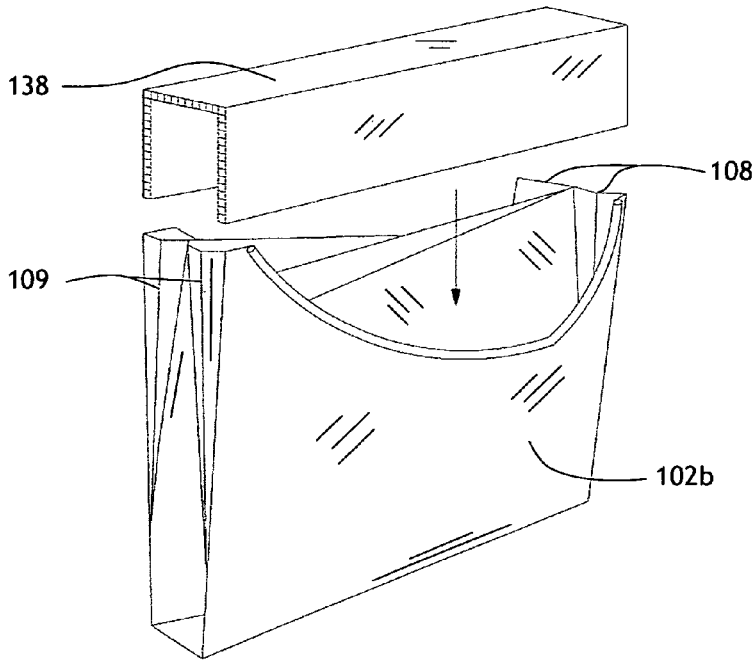

With regard to FIG. 17, the confronting vertices 142 are diverted slightly laterally as they are brought into approximation, and the end sections 103 and 104 begin to fold about lines 116 as the side portions 102*a* and 102*b* continue to rotate toward each other. As a result, the folding end sections 103 and 104 slide past each other as they collapse together, with the end section 104 folded substantially flat along axis 114 and impinging on the inner surface of side portion 102*a* of the central section 102 (FIG. 18). In a like manner, the end section 103 is folded substantially flat and impinging on the inner surface of side portion 102*b* of the central section 102. The outer ends of the darts 108 and 109 form corners of the folded structure, and these corners are brought into approximation by completely rotating the side portions 102*a* and 102*b* together, thus defining the carrying case of FIG. 19. The spaces between the folded panels within the case may be used to store the cross-rib, bow fairing, paddles, and other ancillary gear. The darts 108 and 109 form gussets that provide volume to the carrying case configuration, and the keel portion 124 forms the bottom of the case. The footboard 138 may be placed over the open top of the carrying case, folded along its fold lines, and secured thereto with a strap, tape, or the like to define an integrally formed, self-storage case for the kayak and its components. The case may be furnished with additional straps or handles for carrying by hand, or as a backpack.

In an alternate embodiment, of the case assembly, the skin may be creased with additional transverse folds, which allow the case to be formed purely in an accordioned or spiraling manner, while remaining unfolded in the transverse direction. In this case, forming a case of sufficiently small size to be portable requires that folds break across the cockpit area, requiring a hinged or removable cockpit rim assembly.

A primary advantage of the folding kayak system described above is that it can be manufactured very cheaply, with common manufacturing equipment used for packaging and other applications. Unlike conventional folding kayaks which must be hand-sewn, or rigid kayaks which must be formed out of thermoplastics using complex three-dimensional molds, the current design can be simply die-stamped out of a flat sheet of material, using machinery commonly found in the paper-converting industries. A typical stamping machine can create both the permanent creases which define the folding lines, and the cut outlines, holes and slots required for various assembly functions. Alternatively, the panel may be formed of a solid or foamed polymer or plastic with fold lines formed by CNC-grooved creases.

The skin may be manufactured and sold separately from the structural components, so that if becomes damaged or worn, it may simply be replaced.

Custom extrusions of the preferred twin-walled plastic skin material may be used to enhance the performance and durability of the kayak. For instance, the outer surface of a custom sheet could be made thicker than the inner surface, in order to better resist abrasion and impacts from rocks, snags, sandbars, and other obstacles.

The same methods and materials may be applied to other portable, collapsible watercraft such as canoes, rowboats, dinghies, sailboats and the like. Likewise, they may also be applied to folding furniture, packaging, and portable structures.

The foregoing description of the preferred embodiments of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

The invention claim is:

1. A collapsible watercraft, comprising:

a panel configuration formed of a stiff, creasable and foldable panel, said panel being provided with a plurality of permanent fold lines to define a plurality of living hinges, said living hinges extending in said panel in a predetermined pattern to enable said panel to be folded along said living hinges from a first, generally planar disposition to a second, assembled disposition in which portions of said panel form a manifold that integrally defines the keel, hull, sides, and deck of a kayak configuration;

said panel including a pair of opposed side edges, and said panel is foldable along said living hinges about a longitudinal axis to form said manifold as a tubular shape in which said opposed side edges are folded inwardly each toward the other and brought together in a longitudinal plane to form said kayak configuration;

further including means for releasably joining said opposed side edges to enclose said kayak configuration.

2. The collapsible watercraft of claim 1, wherein said panel extends longitudinally along said longitudinal axis, and said pattern is symmetrical about said longitudinal axis.

3. The collapsible watercraft of claim 2, wherein said panel includes a central section and opposed fore and aft sections extending from longitudinally opposed ends of said central section.

4. The collapsible watercraft of claim 3, wherein said pair of opposed side edges include a pair of concave, scalloped portions extending into the laterally opposed edges of said central section, said concave portions defining a cockpit opening in said kayak configuration.

5. The collapsible watercraft of claim 3, wherein said pair of opposed side edges at said fore section of said panel taper from said central section to define a longitudinally tapering bow section of said kayak configuration.

6. The collapsible watercraft of claim 5, wherein said pair of opposed side edges at said aft section of said panel taper from said central section to define a longitudinally tapering stern section of said kayak configuration.

7. The collapsible watercraft of claim 6, wherein said permanent fold lines include three pair of fold lines extending longitudinally in said panel entirely through said fore section, said central section and said aft section, each of said three pair of fold line being symmetrical about said longitudinal axis.

8. The collapsible watercraft of claim 7, wherein a first pair of said three pair of fold lines are spaced apart equally from said longitudinal axis and define therebetween said keel of said kayak configuration.

9. The collapsible watercraft of claim 8, wherein a second pair of said three pair of fold lines are spaced apart from said first pair of fold lines, each first and second pair of lines defining therebetween a longitudinal strip of said panel that comprises a bottom portion of said kayak configuration.

10. The collapsible watercraft of claim 9, wherein a third pair of said three pair of fold lines are spaced apart from said second pair of fold lines, each second and third pair of lines defining therebetween a longitudinal strip of said panel that comprises a side portion of said kayak configuration.

11. The collapsible watercraft of claim 10, wherein said third pair of said three pair of fold lines are spaced laterally inwardly of said opposed side edges to define therebetween the deck portions of said kayak configuration.

12. The collapsible watercraft of claim 5, further including a first pair of darts formed in said panel and located at the boundary between said central section and said fore section of said panel, said darts each opening outwardly to a respective one of said opposed side edges.

13. The collapsible watercraft of claim 12, further including a second pair of darts formed in said panel and located at the boundary between said central section and said aft section of said panel, said second pair of darts each opening outwardly to a respective one of said opposed side edges.

14. The collapsible watercraft of claim 1, where said means for releasably joining said opposed side edges includes a plurality of adjustable buckle assemblies extending from said opposed side edges in snap-engaging, length-adjustable fashion.

15. The collapsible watercraft of claim 1, further including sealing means extending the lengths of said opposed side edges, and means for releasably joining said sealing means to enclose said kayak configuration.

16. The collapsible watercraft of claim 3, further including a pair of V-shaped fold lines formed in opposed ends of said fore and aft sections, said V-shaped fold lines being symmetrical about said longitudinal axis.

17. The collapsible watercraft of claim 16, wherein each V-shaped fold line enables said opposed ends of said fore and aft sections to be folded inwardly toward the central section, bringing together opposed sides of said panel at said fore and aft sections to define a pointed bow at the fore section and a pointed stern at the aft section, each having four plies of said panel accordion-folded together.

18. The collapsible watercraft of claim 3, wherein said pattern further includes a plurality of lateral fold lines to enable said panel to be folded into a self-defined carrying case for the collapsible watercraft.

19. The collapsible watercraft of claim 18, wherein said plurality of lateral fold lines includes two pair of lateral fold lines spanning said opposed side edges.

20. The collapsible watercraft of claim 19, wherein a first pair of said lateral fold lines define the boundaries between said central section and said fore and aft sections.

21. The collapsible watercraft of claim 20, wherein a second pair of said lateral fold lines are disposed intermediate of said first pair of lateral fold lines and the respective adjacent fore or aft end of said panel.

22. A collapsible watercraft, comprising:

a panel configuration formed of a stiff, creasable and foldable panel, said panel being provided with a plurality of permanent fold lines to define a plurality of living hinges, said living hinges extending in said panel in a predetermined pattern to enable said panel to be folded along said living hinges from a first, generally planar disposition to a second, assembled disposition in which portions of said panel form a manifold that integrally defines the keel, hull, sides, and deck of a kayak configuration;

wherein said pattern is further defined to enable said panel to be folded into a self-defined carrying case for the collapsible watercraft.

* * * * *